US009194078B2

(12) United States Patent
Iverson et al.

(10) Patent No.: US 9,194,078 B2
(45) Date of Patent: Nov. 24, 2015

(54) SOIL REPELLENCY AQUEOUS DISPERSIONS, SOIL REPELLANT SOFT ARTICLES, AND METHODS OF MAKING THE SAME

(75) Inventors: Isaac Keene Iverson, Colombia, SC (US); Martin August Rudat, Woodstock, GA (US)

(73) Assignee: INVISTA North America S.a.r.l., Wilmington, DE (US)

( * ) Notice: Subject to any disclaimer, the term of this patent is extended or adjusted under 35 U.S.C. 154(b) by 679 days.

(21) Appl. No.: 12/965,395

(22) Filed: Dec. 10, 2010

(65) Prior Publication Data

US 2011/0311757 A1 Dec. 22, 2011

Related U.S. Application Data

(60) Provisional application No. 61/285,425, filed on Dec. 10, 2009.

(51) Int. Cl.

| | |
|---|---|
| ***D06M 11/00*** | (2006.01) |
| ***D06M 15/277*** | (2006.01) |
| ***D06M 13/428*** | (2006.01) |
| ***D06M 15/576*** | (2006.01) |
| ***D06M 23/08*** | (2006.01) |
| *D06N 7/00* | (2006.01) |
| *D06M 23/06* | (2006.01) |
| *D06M 101/34* | (2006.01) |

(52) U.S. Cl.

CPC ..... *D06M 11/00* (2013.01); *D06M 13/428* (2013.01); *D06M 15/277* (2013.01); *D06M 15/576* (2013.01); *D06M 23/08* (2013.01); *D06M 23/06* (2013.01); *D06M 2101/34* (2013.01); *D06M 2200/01* (2013.01); *D06N 7/0065* (2013.01); *Y10T 428/2933* (2015.01)

(58) Field of Classification Search

CPC ..... D06M 2200/01; D06M 2101/34; D06M 23/08; D06M 11/00; D06M 13/428; D06M 15/277; D06M 15/576; D06N 7/0065; D06N 2201/0263; B82Y 30/00

USPC ..... 428/96, 375; 442/93, 94

See application file for complete search history.

(56) References Cited

U.S. PATENT DOCUMENTS

| | | | | |
|---|---|---|---|---|
| 3,398,182 | A | 8/1968 | Guenthner et al. | |
| 3,484,281 | A * | 12/1969 | Guenthner et al. | 442/92 |
| 3,574,791 | A | 4/1971 | Sherman et al. | |
| 4,024,178 | A | 5/1977 | Landucci | |
| 4,147,851 | A | 4/1979 | Raynolds | |
| 4,540,497 | A | 9/1985 | Chang et al. | |
| 4,606,737 | A | 8/1986 | Stern | |
| 5,888,290 | A | 3/1999 | Engle et al. | |
| 6,225,403 | B1 | 5/2001 | Knowlton | |
| 6,710,123 | B1 * | 3/2004 | Amin-Sanayei et al. | 524/805 |
| 7,893,014 | B2 * | 2/2011 | van Buskirk et al. | 510/327 |
| 2003/0026997 | A1 | 2/2003 | Qiu et al. | |
| 2005/0266753 | A1 * | 12/2005 | Fang et al. | 442/76 |
| 2006/0167139 | A1 * | 7/2006 | Nelson et al. | 523/212 |
| 2006/0189750 | A1 * | 8/2006 | Maier et al. | 524/589 |
| 2008/0277346 | A1 * | 11/2008 | Kirkland et al. | 210/656 |
| 2008/0287020 | A1 * | 11/2008 | Rudat | 442/94 |
| 2009/0048571 | A1 * | 2/2009 | Catalan et al. | 604/367 |
| 2009/0240004 | A1 * | 9/2009 | Maier et al. | 525/457 |
| 2010/0215894 | A1 * | 8/2010 | Iverson et al. | 428/87 |
| 2014/0102651 | A1 * | 4/2014 | Johnston et al. | 162/164.6 |
| 2014/0220840 | A1 * | 8/2014 | Koene et al. | 442/80 |
| 2015/0004351 | A1 * | 1/2015 | Iverson et al. | 428/87 |

FOREIGN PATENT DOCUMENTS

| | | | |
|---|---|---|---|
| CN | 102387985 | A | 3/2012 |
| WO | 20091002994 | A1 | 12/2008 |

OTHER PUBLICATIONS

Search Report dated May 20, 2014, for Chinese Patent Application No. 201080055884.0, 2 pages.

* cited by examiner

*Primary Examiner* — Cheryl Juska
(74) *Attorney, Agent, or Firm* — Joseph N. Mooniely

(57) ABSTRACT

A soil repellency aqueous dispersion for treating various fibers, yarns, and textiles is disclosed. The dispersion provides superior soil resistance when compared to known fluorochemical and silicone fiber treatments. The dispersion comprises clay nanoparticle components and fluorochemicals that can be applied to the fibers, yarns, and textiles using known methods.

20 Claims, No Drawings

SOIL REPELLENCY AQUEOUS DISPERSIONS, SOIL REPELLANT SOFT ARTICLES, AND METHODS OF MAKING THE SAME

CROSS-REFERENCE TO RELATED APPLICATION

This application claims benefit of priority from U.S. Provisional Application No. 61/285,425 filed Dec. 10, 2009.

FIELD OF THE INVENTION

The invention relates to soil repellency aqueous dispersions comprising a colloidal dispersion of clay nanoparticles and an aqueous fluorochemical. Soil repellant soft articles that have been modified by the soil repellency aqueous dispersions, which result in having improved anti-soil properties, are also disclosed. The soft articles can comprise fibers, yarns, and textiles. Also disclosed herein are processes for making the soil repellency aqueous dispersions and soil repellant soft articles.

BACKGROUND OF THE TECHNOLOGY

Sub-micron particles of inorganic oxides (i.e. silica) have been applied topically to polyamide fibers in the past to provide anti-soil deposition benefits, but have suffered from poor durability and harsh texture. Additionally, the silica treated surfaces can have an unappealing white haze at certain deposition concentrations. Fluorochemical resin emulsions have been used to create low soiling soft surfaces.

U.S. Pat. No. 6,225,403 teaches the use of surface treating compositions comprised of a blend of fluorochemical resins with colloidal sol dispersions of organosiloxane co-polymers. This blend allows for significantly reduced add-on levels of fluorochemicals on soft-surfaces to achieve acceptable soil repellency. However, these colloidal siloxane fluorine extenders can impart a harsh feel to the soft surface which is undesirable.

SUMMARY OF THE INVENTION

There is a desire to reduce the overall usage of fluorochemicals for environmental and cost reasons. Thus, it can be understood that soil repellency compositions that reduce the amount of fluorochemicals used, but still retain good soil-resistance, are in demand.

Therefore, it is desirable to further extend the effectiveness of fluorochemicals and to produce a softer hand fiber while retaining desirable soil-resistant attributes.

The invention disclosed herein provides soil repellency aqueous dispersions comprising aqueous dispersions of clay nanoparticles that can be combined with traditional fluorochemicals. The clay nanoparticles can be added to anti-soil formulations and water/oil repellant formulations. Fibers treated with the disclosed dispersions show superior anti-soil deposition and dry soil repellency properties over prior fluorochemical and silicone treated fibers. Treated fibers also show softer hand feel and better durability over prior fluorochemical or silicone treated fibers. The nanoparticles are shown to act as a fluorochemical extender allowing anti-soiling properties on the fiber at reduced fluorine levels on the weight of fiber. Also provided are methods of making the disclosed aqueous dispersions and treated fibers. Further provided are yarns and textiles, such as fabrics and carpets, made with various aspects of the treated fibers.

Clay nanoparticles can be effective diluents for fluorochemicals in fluorochemical water and oil repellency treatment compositions directed to fibrous soft surfaces. Specifically, the amount of fluorochemical required for a given anti-soil effect is surprisingly reduced by inclusion of clay nanoparticles in the fluorochemical formulation or emulsion, resulting in effective soil repellency at substantially reduced fluorine levels compared to the prior formulations. When fibers are treated with the disclosed aqueous dispersions, the clay particles are essentially hydrophilic but are still effective as extenders of the hydrophobic properties that would otherwise be expected to depend on the fluorochemical concentration alone. Under certain conditions, aqueous dispersions of clay nanoparticles are shown to impart many of the same benefits expected from fluorochemicals alone.

In one aspect, an aqueous dispersion for soil repellency comprising at least one clay nanoparticle component and a fluorochemical is provided. The clay nanoparticle component can be either natural or synthetic. The fluorochemical can comprise any chemical containing a carbon-fluorine moiety.

In another aspect, a fiber comprising a surface treatment comprising at least one clay nanoparticle component and a fluorochemical is provided. The fiber can be any natural or synthetic fiber, including cotton, silk, wool, rayon, polyamide, acetate, olefin, acrylic, polypropylene, and polyester. The fiber can be spun into a yarn or manufactured into a textile.

In a further aspect, a textile comprising at least one fiber treated with a soil repellency aqueous dispersion comprising at least one clay nanoparticle component and a fluorochemical is provided. The textile can be any woven fabric or carpet. The carpet can include cut pile, twisted, woven, needlefelt, knotted, tufted, flatweave, frieze, berber, and loop pile.

In yet another aspect, a process of making a soil repellency aqueous dispersion is provided. Such process comprises contacting at least one clay nanoparticle component with a solvent to form an aqueous clay nanoparticle solution, and contacting said aqueous clay nanoparticle solution with a fluorochemical to form the soil repellency aqueous dispersions.

In yet a further aspect, a process of making a soil repellant fiber using soil repellency aqueous dispersions discussed above is provided. Such process comprises applying said aqueous dispersions onto said fiber in an amount resulting in said at least one clay nanoparticle component present in an amount from about 200 ppm (parts per million-particle weight per weight of the fiber) to about 4000 ppm OWF, including from about 500 ppm to about 1500 ppm OWF, from about 500 ppm to about 1000 ppm OWF, from about 1000 ppm to about 1500 ppm, from about 1000 ppm to about 2000 ppm OWF, and from about 1500 ppm to about 2000 ppm OWF, on the surface of the fiber; and said fluorochemical present in an amount that results in an elemental fluorine content of from about 25 ppm to about 1000 ppm OWF, including from about 25 to about 500 ppm OWF, from about 75 ppm to about 150 ppm OWF, from about 75 ppm to about 200 ppm OWF, from about 100 ppm to about 200 ppm OWF, and from about 140 ppm to about 150 ppm OWF, on the surface of said fiber. The fiber is then cured. (Curing refers to the process of drying the solvent used to carry the solution onto the fiber. This can optionally be done using a heating step.) The same process can be applied to yarns and textiles.

DEFINITIONS

While mostly familiar to those versed in the art, the following definitions are provided in the interest of clarity.

Nanoparticle: A multidimensional particle in which one of its dimensions is less than 100 nm in length.

OWF (On weight of fiber): The amount of solids that were applied after drying off the solvent.

WPU (Wet Pick-up): The amount of solution weight that was applied to the fiber before drying off the solvent.

DETAILED DESCRIPTION OF THE INVENTION

A soil repellency aqueous dispersion is disclosed comprising at least one clay nanoparticle component and a fluorochemical. The clay nanoparticle component can refer to particles substantially comprising minerals of the following geological classes: smectites, kaolins, illites, chlorites, and attapulgites. These classes include specific clays such as montmorillonite, bentonite, pyrophyllite, hectorite, saponite, sauconite, nontronite, talc, beidellite, volchonskoite, vermiculite, kaolinite, dickite, antigorite, anauxite, indellite, chrysotile, bravaisite, suscovite, paragonite, biotite, corrensite, penninite, donbassite, sudoite, pennine, sepiolite, and polygorskyte. The clay nanoparticles can be either synthetic or natural, including synthetic hectorite, and Laponite® from Rockwood Additives Ltd. The Laponite® clay nanoparticles can be Laponite RD®, Laponite RDS®, Laponite JS®, and Laponite S482®.

The fluorochemicals can include any liquid containing at least one dispersed or emulsified fluorine containing polymer or oligomer. The liquid can also contain other non-fluorine containing compounds. Examples of fluorochemical compositions used in the disclosed composition include anionic, cationic, or nonionic fluorochemicals such as the fluorochemical allophanates disclosed in U.S. Pat. No. 4,606,737; fluorochemical polyacrylates disclosed in U.S. Pat. Nos. 3,574,791 and 4,147,85; fluorochemical urethanes disclosed in U.S. Pat. No. 3,398,182; fluorochemical carbodiimides disclosed in U.S. Pat. No. 4,024,178; and fluorochemical guanidines disclosed in U.S. Pat. No. 4,540,497. The above listed patents are hereby incorporated by reference in their entirety. A short chain fluorochemical with less than or equal to six fluorinated carbons per fluorinated side-chain bound to the active ingredient polymer or surfactant can also be used. The short chain fluorochemicals can be made using fluorotelomer raw materials or by electrochemical fluorination. Another fluorochemical that can be used in the disclosed composition is a fluorochemical emulsion sold as Capstone RCP® from DuPont.

The disclosed soil repellency aqueous dispersion can be made using various techniques. One technique comprises contacting at least one clay nanoparticle component with water to form an aqueous clay nanoparticle solution. Aqueous solvent mixtures containing low molecular weight alcohols (such as methanol, ethanol, isopropanol, and the like) can also be used to disperse the clay. The clay nanoparticle component can be present in an amount from about 0.01% to about 25% weight in solution, including about 1% to about 20%, about 0.05% to about 15%, about 0.01% to about 5%, about 0.05% to about 5%, about 0.5% to about 5%, and about 5% to about 15%. When Laponite® is used as the clay nanoparticle, the concentration is from about 0.05% to about 25% weight in solution, including from about 0.05% to 1% w/w and from about 5% to about 15% w/w. The aqueous clay nanoparticle solution is then contacted with a fluorochemical to form the soil repellency aqueous dispersion. The % elemental fluorine in the combined dispersion can be present in an amount from about 0.0001% to about 5% weight fluorine atoms present in dispersion, including about 0.001% to about 2%, about 0.001% to about 0.8%, about 0.005% to about 0.5%, about 0.005% to about 0.15%, about 0.01% to about 1%, about 0.025% to about 0.5%, and about 0.05% to about 0.5%. When Capstone RCP® is used as the fluorochemical, the concentration is from about 0.005% to about 0.5%, including from about 0.005% to about 0.15% depending on the wet pick-up percentage of the application to the fibers. When formulating the aqueous dispersions, the weight percent of clay nanoparticle component should remain higher than the weight percent fluorine. Typical weight percent ratios of clay nanoparticles to fluorine range from about 5000:1 to about 2:1, including about 3000:1, about 1500:1, about 1000:1, about 500:1, about 100:1, about 50:1, about 25:1, and about 10:1.

The disclosed soil repellency aqueous dispersion can be applied to various types of fibers as a surface treatment. The fiber can be any natural or synthetic fiber, including cotton, silk, wool, rayon, polyamide, acetate, olefin, acrylic, polypropylene, and polyester. The fiber can also be polyhexamethylene adipamide, polycaprolactam, Nylon 6,6 or Nylon 6. The fibers can be spun into yarns or woven into various textiles. Yarns can include low oriented yarn, partially oriented yarn, fully drawn yarn, flat drawn yarn, draw textured yarn, air-jet textured yarn, bulked continuous filament yarn, and spun staple. Textiles can include carpets and fabrics, wherein carpets can include cut pile, twisted, woven, needlefelt, knotted, tufted, flatweave, frieze, berber, and loop pile. Alternatively, the disclosed soil repellency aqueous dispersions can be applied to a yarn or textile, instead of the fiber.

The disclosed soil repellency aqueous dispersions can be applied to a fiber using various techniques known in the art. Such techniques include spraying, dipping, coating, foaming, painting, brushing, and rolling the soil repellency aqueous dispersion on to the fiber. The soil repellency aqueous dispersions can also be applied on the yarn spun from the fiber or a textile made from the fiber. After application, the fiber, yarn, or textile is than heat cured at a temperature of from about 25° C. to about 200° C., including from about 150° C. to about 160° C.; and a time of from about 10 seconds to about 40 minutes, including 5 minutes.

Once applied, the clay nanoparticle component can be present in an amount from about 200 ppm to about 4000 ppm OWF, including from about 500 ppm to about 1500 ppm OWF, from about 500 ppm to about 1000 ppm OWF, from about 1000 ppm to about 1500 ppm OWF, from about 1000 ppm to about 2000 ppm OWF and from about 1500 ppm to about 2000 ppm OWF, on the surface of the fiber, yarn or textile. The fluorochemical can also be present in an amount that results in an elemental fluorine content of from about 25 ppm to about 1000 ppm OWF, including from about 25 ppm to about 500 ppm OWF, from about 75 ppm to about 150 ppm OWF, from about 75 ppm to about 200 ppm OWF, from about 100 ppm to about 200 ppm OWF, and from about 140 ppm to about 150 ppm OWF, on the surface of the fiber, yarn or textile. When applying the aqueous dispersions, the OWF of the clay nanoparticle component should remain higher than the OWF of fluorine. Typical OWF ratios of nanoparticles to fluorine can range from about 80:1 to about 1.5:1, including about 27:1, about 20:1, about 13:1, about 10:1, about 7.5:1, and about 5:1. Fibers, yarns, and textiles with these surface concentrations have a Delta E of from about 15 to about 23 when measured using ASTM D6540.

Additional components can be added to the soil repellency composition disclosed above. Such components can include silicones, optical brighteners, antibacterial components, antioxidant stabilizers, coloring agents, light stabilizers, UV absorbers, base dyes, and acid dyes. Optical brighteners can include a triazine type, a coumarin type, a benzoxaxole type, a stilbene type, and 2,2'-(1,2-ethenediyldi-4,1 phenylene)bisbenzoxazole, where the brightener is present in an amount by weight of total composition from about 0.005% to about 0.2%. Antimicrobial components can include silver containing compounds, where the antimicrobial component is present in an amount by weight of total composition from about 2 ppm to about 1%.

The nanoparticles are shown to act as a fluorochemical extender allowing anti-soiling properties on the fiber at reduced fluorine levels on the weight of fiber.

EXAMPLES

The following are examples of Nylon 6,6 46 ounce cut-pile carpet treated with the soil repellency aqueous dispersions disclosed above compared to a standard fluorochemical emulsion treatment (comparative), and no treatment. Selection of alternative fluorochemicals, clay nanoparticles, fibers and textiles having different surface chemistries will necessitate minor adjustments to the variables herein described.

Test Methods

Drum soiling is recorded as Delta E and measured according to ASTM D6540 and D1776.

Table 1, below, lists the various carpet samples: (1) treated with the various aspects of the disclosed soil repellency composition (Samples 1-12); (2) treated with a standard fluorochemical emulsion treatment (Sample 13-comparative); and (3) untreated (Sample 14-untreated).

TABLE 1

| Sample # | Clay Nanoparticle | ppm OWF (on weight of fiber) clay | ppm OWF elemental flourine |
|---|---|---|---|
| 1 | Laponite ® RD | 1750 | 0 |
| 2 | Laponite ® RDS | 1740 | 0 |
| 3 | Laponite ® JS | 1950 | 0 |
| 4 | Laponite ® RD | 1700 | 150 |
| 5 | Laponite ® RDS | 1800 | 150 |
| 6 | Laponite ® JS | 1830 | 140 |
| 7 | Laponite ® RDS | 1500 | 150 |
| 8 | Laponite ® RDS | 1000 | 75 |
| 9 | Laponite ® RDS | 2000 | 75 |
| 10 | Laponite ® RDS | 1500 | 150 |
| 11 | Laponite ® RDS | 1000 | 200 |
| 12 | Laponite ® RDS | 2000 | 200 |
| 13 (comparative) | NA | 0 | 640 |
| 14 (untreated) | NA | 0 | 0 |

Samples 1-7 were all prepared in a similar manner, with the main difference being the weight percent and type of stock Laponite® solution made and the addition of Capstone® RCP to Samples 4-7. For illustrative purposes only, the following describes the method of preparing Sample 7: A 5% by weight stock solution of Laponite® RDS was made by incrementally adding the nanoclay to stirring water that was heated to about 38° C. After addition was completed, the vessel was moved to a cool stir plate and continued to stir until the solution was dispersion clear and at room temperature. In a bottle were combined 6 wt % Capstone® RCP, 60 wt % of the Laponite® dispersion, and the remainder dionized water. The solution was shaken, poured into the reservoir of an 8 ounce spray bottle, and primed into a waste container. The spray bottle was clamped onto a ring stand approximately 12 inches from the base and aimed at a downward angle. The spray pattern was tested and centered on a grid. A tare weight for the carpet was obtained, then the carpet was placed on the grid so that the bottom right corner of the carpet would be contacted by the spray. The carpet was then moved so that the bottom half of the carpet would be sprayed. The carpet was again moved so that the left bottom corner was sprayed, then the left half, then top left corner, top half, top right corner, and right half, followed by a spray aimed at the center to achieve full coverage. After spraying on the carpet surface, the carpet was cured in a convection oven at 150° C. for 5 minutes. The resulting dispersions, when sprayed on the Sample at about 5% WPU, resulted in 1500 ppm OWF of clay nanoparticles and 150 ppm OWF of elemental flourine on the surface of the Sample.

Samples 8-12 were prepared in a similar manner, except that the resulting dispersions, when sprayed on the Samples at 10% WPU, resulted in from about 1000-2000 ppm OWF of clay nanoparticles and from about 75 ppm -200 ppm OWF elemental fluorine, on the surface of the Samples.

Sample 13 was prepared with a 13.3 wt % Capstone® RCP solution and following a spray pattern similar to the method described above at a 10% wet-pick up, which resulted in 640 ppm OWF of elemental fluorine on the surface.

The Samples were then soiled according to ASTM D6540. For Samples 1-7 and 13, each drum load contained at least one piece of untreated control carpet ("Control").

Tables 2 and 3, below, lists the Delta E values for Samples 1-14. Table 2 compares the Delta E values for Samples 1-7, and 13 with the Control described in the previous paragraph. Table 3 compares Samples 8-12 with Sample 13, which is the fluorine only treated carpet

TABLE 2

| Sample # | Sample Delta E with Std. Dev. | Control Delta E with Std. Dev. | % soil retained vs. Control |
|---|---|---|---|
| 1 | 15.7 ± 0.6 | 19.6 ± 0.6 | 80 |
| 2 | 15.1 ± 1.2 | 18.7 ± 0.6 | 81 |
| 3 | 15.5 ± 0.3 | 18.6 ± 0.1 | 83 |
| 4 | 14.9 ± 1.0 | 19.6 ± 0.6 | 76 |
| 5 | 14.1 ± 0.8 | 18.7 ± 0.6 | 75 |
| 6 | 14.3 ± 0.7 | 18.6 ± 0.1 | 77 |
| 7 | 16.1 ± 1.0 | 23.4 ± 0.5 | 69 |
| 13 (comparative) | 16.0 ± 0.8 | 20.1 ±. 0.5 | 80 |
| 14 (untreated) | 21.9 ± 1.0 | NA | NA |

Samples 1-7 show between a 17% to 31% decrease in soil retained verses the Control.

TABLE 3

| Sample # | Sample Delta E with Std. Dev. | Delta E difference to Sample 13 |
|---|---|---|
| 8 | 18.1 ± 0.7 | −2.1 |
| 9 | 16.5 ± 1.6 | −0.5 |
| 10 | 15.0 ± 0.6 | +1.0 |
| 11 | 17.0 ± 1.2 | −1.0 |
| 12 | 15.5 ± 0.8 | +0.5 |
| 13 (comparative) | 16.0 ± 0.8 | — |
| 14 (untreated) | 21.9 ± 1.0 | +5.9 |

Samples 8-12, when compared to Sample 13, show the benefit of the clay nano-particles, which result in about the same Delta E to 1.0 decrease in Delta E over a carpet with 3× the fluorine and no clay nano-particles (Sample 13). Thus, a more environmentally friendly carpet fiber, with the same or improved drum soiling, can be achieved with the disclosed soil repellency aqueous dispersions.

The invention has been described above with reference to the various aspects of the disclosed soil repellency aqueous dispersions, treated fibers, yarns, and textiles, and methods of making the same. Obvious modifications and alterations will occur to others upon reading and understanding the proceeding detailed description. It is intended that the invention be construed as including all such modifications and alterations insofar as they come within the scope of the claims.

What we claim is:

1. A fiber comprising a surface treatment comprising at least one clay nanoparticle component and a fluorochemical, wherein said fluorochemical is selected from the group consisting of fluorochemical allophanates, fluorochemical polyacrylates, fluorochemical urethanes, fluorochemical carbodiimides, and fluorochemical quanidines and wherein said fluorochemical has less than or equal to six fluorinated carbons per fluorinated side-chain, and wherein said at least one clay nanoparticle component is selected from the group consisting of montmorillonite, hectorite, saponite, nontronite, beidellite and combinations thereof.

2. The fiber of claim& 1, wherein said at least one clay nanoparticle component is synthetic.

3. The fiber of claim 1, wherein said at least one clay nanoparticle component is synthetic hectorite.

4. The fiber of claim 3, wherein said fluorochemical is fluorochemical urethane.

5. The fiber of claim 1, wherein said at least one clay nanoparticle component is present in an amount from about 200 ppm to about 4000 ppm OWF on the surface of said fiber.

6. The fiber of claim 1, wherein said fluorochemical is present in an amount that results in a surface fluorine content from about 25 ppm to about 1000 ppm OWF.

7. The fiber of one of claim 1, 3 or 4-6, wherein said fiber is a polyamide.

8. The fiber of claim 1, wherein said at least one clay nanoparticle component is synthetic hectorite in an amount from about 500 ppm to about 1500 ppm OWF on the surface of said fiber; and said fluorochemical has per fluorinated side-chains with less than or equal to six fluorinated carbons and is present in an amount from about 75 ppm to about 200 ppm OWE on the surface of the fiber.

9. The fiber of claim 1, wherein said at least one clay nanoparticle component is synthetic hectorite in an amount from about 500 ppm to about 1000 ppm OWF on the surface of said fiber; and said fluorochemical has per fluorinated side-chains with less than or equal to six fluorinated carbons and is present in an amount from about 75 ppm to about 200 ppm OWF on the surface of the fiber.

10. The fiber of claim 1, wherein said at least one clay nanoparticle component is synthetic hectorite in an amount from about 1000 ppm to about 1500 ppm OWF on the surface of said fiber; and said fluorochemical has per fluorinated side-chains with less than or equal to six fluorinated carbons and is present in an amount from about 75 ppm to about 200 ppm OWF on the surface of the fiber.

11. The fiber of claim 1, wherein said at least one clay nanoparticle component is synthetic hectorite in an amount from about 1500 ppm to about 2000 ppm OWF on the surface of said fiber; and said fluorochemical has perfluorinated side-chains with less than or equal to six fluorinated carbons and is present in an amount from about 75 ppm to about 200 ppm OWF on the surface of the fiber.

12. A textile comprising a fiber from one of claims 1, 4-6, and 8-11.

13. The textile of claim 12, wherein said fiber is a polyamide.

14. A carpet comprising a fiber from one of claims 1 4-6, and 8-11.

15. The carpet of claim 14, wherein said fiber is a polyamide.

16. The carpet of claim 14 further comprising a Delta E of from about 15 to about 23. wherein Delta E is measured using ASTM D6540.

17. The carpet of claim 15 further comprising a Delta E of from about 15 to about 23. wherein Delta E is measured using ASTM D6540.

18. An article comprising:

a fiber comprising at least one clay nanoparticle component, a fluorochemical and a component selected from the group consisting of silicones, optical brighteners, antibacterial components, anti-oxidant stabilizers, coloring agents, light stabilizers, UV absorbers, base dyes, and acid dyes, and wherein said at least one clay nanoparticle component is selected from the group consisting of montmorillonite, hectorite, saponite, nontronite, beidellite and combinations thereof.

19. A textile comprising said fiber from claim 18.

20. A carpet comprising said fiber from claim 18.

* * * * *